United States Patent [19]

Denny

[11] 4,271,400

[45] Jun. 2, 1981

[54] CRADLE ASSEMBLY FOR USE IN A THERMOSTAT

[75] Inventor: Dann W. Denny, Morrison, Ill.

[73] Assignee: General Electric Company, Fort Wayne, Ind.

[21] Appl. No.: 937,509

[22] Filed: Aug. 28, 1978

Related U.S. Application Data

[63] Continuation-in-part of Ser. No. 750,279, Dec. 13, 1976, abandoned.

[51] Int. Cl.[3] ..... H01H 37/04

[52] U.S. Cl. ..... 337/380; 337/112; 337/374

[58] Field of Search ..... 337/80, 331, 336, 371, 337/373, 375, 374, 112, 380

[56] References Cited

U.S. PATENT DOCUMENTS

| | | | |
|---|---|---|---|
| 2,051,853 | 8/1936 | Hodgeman | 337/336 |
| 2,299,580 | 10/1942 | Kronmiller | 337/339 |
| 2,506,623 | 5/1950 | Williams | 337/307 X |
| 3,087,032 | 4/1963 | Fleury | 337/84 |
| 3,310,646 | 3/1967 | Eduards | 337/340 |
| 3,993,120 | 11/1976 | Iberg et al. | 337/331 X |

*Primary Examiner*—R. L. Moses

*Attorney, Agent, or Firm*—Joseph E. Papin

[57] ABSTRACT

A cradle assembly for supporting a pair of switch means adapted for operation at predetermined trip points. The cradle has a pair of means for mounting the switch means pivotally arranged with each other and adjustably movable toward an adjusted position to establish the predetermined trip points of the switch means, respectively. The mounting means include a pair of integrally formed means adapted for fixed interconnection with each other to prevent pivotal displacement movement of the mounting means from the adjusted position thereof and positively maintain the predetermined trip points of the switch means.

19 Claims, 15 Drawing Figures

CRADLE ASSEMBLY FOR USE IN A THERMOSTAT

CROSS REFERENCE TO RELATED APPLICATION

This application is a continuation-in-part of application Ser. No. 750,279 filed Dec. 13, 1976 now abandoned which is incorporated by reference herein.

BACKGROUND OF THE INVENTION

This invention relates generally to thermostats and in particular to a cradle or cradle assembly for switch means supporting use therein.

In the past, thermostats operable in both a heating mode and a cooling mode utilized various types of cradles or brackets for supporting or mounting a pair of switch means, such as mercury switches for instance. At least some of these past thermostats utilized a spirally wound bimetal element for sensing the temperature of a given space in which the thermostats were adapted to be located, and a cradle having a pair of the mercury switches supported thereon was attached to the bimetal element for conjoint movement therewith not only in response to the temperature of the given space but also to adjusted positions in response to manual movement of a temperature selector arm drivingly associated with the bimetal element. Of course, in the heating mode operation and the cooling mode operation of the thermostat, the mercury switches were responsive to movement of the bimetal element to control the operation of a system associated with the given space for conditioning the temperature thereof. Two of such past thermostats are illustrated in copending applications Ser. No. 750,277 filed Dec. 13, 1976 (now U.S. Pat. No. 4,115,751 issued Sept. 19, 1978) and Ser. No. 750,280 filed Dec. 13, 1976 (now U.S. Pat. No. 4,114,681 issued Sept. 19, 1978), which are also specifically incorporated by reference herein.

At least some of the past cradles were provided with a pair of generally planar leg portions formed of a thin metallic material and having opposite ends, respectively. The mercury switches were mounted by various suitable means intermediate the opposite ends of the cradle leg portions, and one of the adjacent opposite ends of the cradle leg portions were pivotally interconnected so that the mercury switches could be positioned or tilted, i.e. with respect to the horizontal, in order to predetermine the trip or switching points thereof. Further, in some of the past cradles, various adjusting mechanisms, such as for instance threaded adjusting screws or eccentric screws or the like, were associated with the cradle leg portions between the other of the opposite ends thereof and operable to effect adjusting pivotal movement of the cradle leg portions to adjusted positions in order to attain the predetermined switching points of the mercury switches respectively carried on the cradle leg portions. However, one of the disadvantages or undesirable features of such past cradles is believed to be that, at least in some instances, they may have become misadjusted through usage so as to deleteriously affect the predetermined trip points of the mercury switches carried thereby. Another disadvantageous or undesirable feature of such past cradles is believed to be that they could be adjusted subsequent to factory calibration in order to alter the predetermined switching points of the mercury switches carried thereby so as to affect the heating mode operation and cooling mode operation of the thermostat. Still another disadvantageous or undesirable feature of the past cradles is believed to be that the adjusting mechanisms associated therewith for predetermining the switching points of the mercury switches were somewhat complex which, of course, results in an analogous economic disadvantageous feature.

SUMMARY OF THE INVENTION

Among the several objects of the invention may be noted the provision of an improved cradle or cradle assembly for use in a thermostat which overcomes the disadvantageous or undesirable features discussed hereinabove, as well as others, with respect to the prior art; the provision of such improved cradle in which the components thereof lend thereselves to simplistic, factory set calibration; the provision of such improved cradle in which switch means are fixed against displacement movement from their predetermined switching points subsequent to factory set calibration; and the provision of such improved cradle in which the components thereof are simplistic in design, economically manufactured, and easily assembled. These as well as other objects and advantageous features of the invention will be in part apparent and in part pointed out hereinafter.

In general, a cradle assembly is provided in one form of the invention for use in a thermostat and has a plurality of switch means respectively adapted for switching operation at predetermined switch points. A plurality of means is provided for mounting the switch means of the plurality thereof, the mounting means of the plurality thereof being pivotally arranged with respect to each other and adjustably movable toward respective adjusted positions so as to establish the predetermined switch points of the switch means. Each of the mounting means includes at least one integrally formed means adapted for fixed connection in displacement preventing engagement directly with another one of the at least one integrally formed means on another one of the mounting means so as to positively secure the mounting means against further movement from their respective adjusted positions thereby to positively maintain the established predetermined switch points of the switch means.

Further in general, a thermostat in one form of the invention has a plurality of means operable generally for switching at predetermined trip points, and means for sensing temperature to which the thermostat may be subjected. A plurality of means for mounting the switching means are pivotally associated and adjustably movable toward respective adjusted positions to establish the predetermined trip points of the switching means with the mounting means of the plurality thereof being supported on said sensing means. Each of the mounting means including at least one integral part associated in displacement preventing engagement directly with another one of the at least one integral part on another one of the mounting means so as to positively maintain the mounting means against further displacement movement from their respective adjusted positions and thereby positively maintain the established predetermined switch points of the switching means.

BRIEF DESCRIPTION OF THE DRAWINGS

Corresponding reference characters indicate corresponding parts throughout the several views of the drawings.

The exemplifications set out herein illustrate the preferred embodiments of the invention in one form thereof, and such exemplifications are not to be construed as limiting in any manner the scope of the invention.

DETAILED DESCRIPTION OF THE PREFERRED EMBODIMENTS

Figure 1:
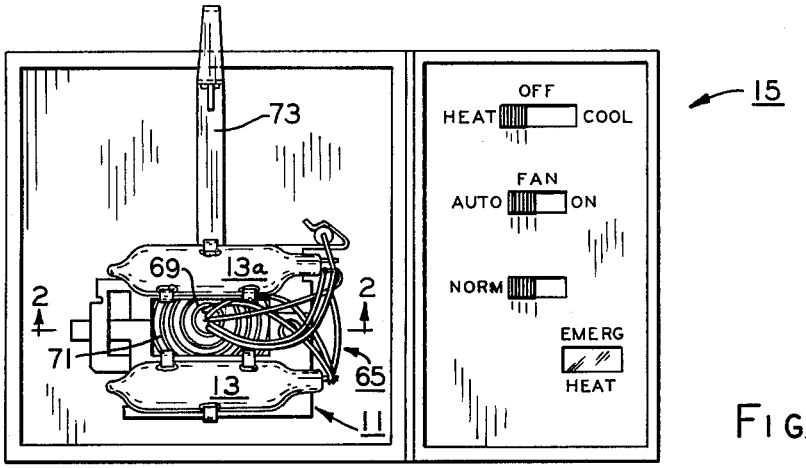
FIG. 1 is a partial plan view of a thermostat in one form of the invention with a cover thereof removed to illustrate a cradle or cradle assembly in one form of the invention.
Figure 4:
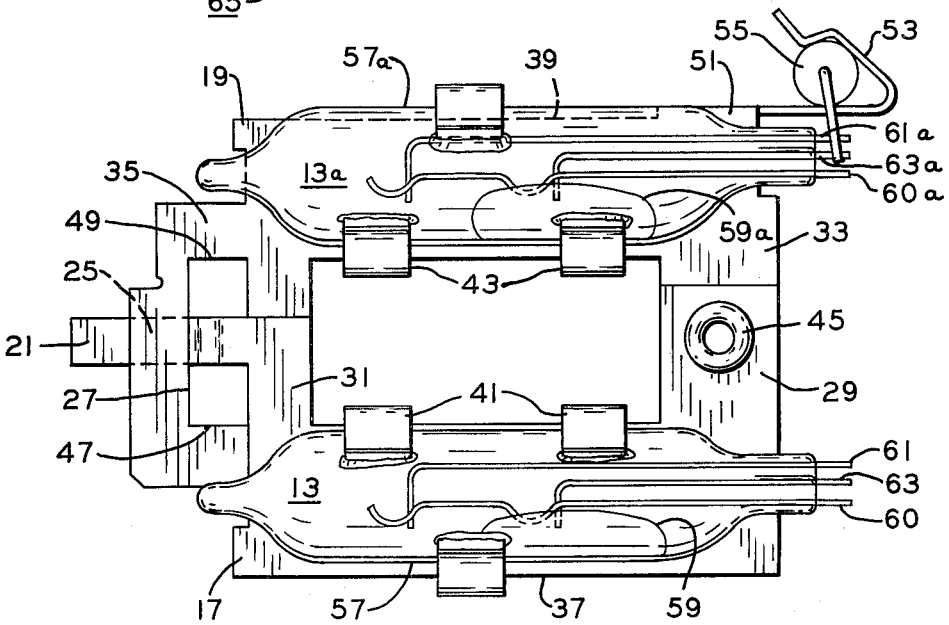
FIG. 4 is an enlarged fragmentary view taken from FIG. 1 showing the cradle assembly in detail and illustrating principles which may be utilized in a method of manufacturing a cradle.

Referring now to the drawings in general, a cradle or cradle assembly 11 is provided in one form of the invention for supporting or mounting a pair of means, such as mercury switches 13, 13*a*, adapted for switching or being operable generally at predetermined trip or switch points in a thermostat 15 (FIG. 1). Cradle 11 has a pair of means, such as legs or leg portions 17, 19, for mounting switches 13, 13*a* with the mounting means or legs 17, 19 being pivotally arranged with each other and adjustably movable toward respective adjusted positions to establish the predetermined trip points of switches 13, 13*a*, respectively (FIGS. 1 and 4). Legs or leg means 17, 19 include a pair of integrally formed means or parts, such as an extension 21 on one of the legs and a portion 25 of the other of the legs generally about an opening 27 therein for instance, adapted for fixed interconnection in displacement preventing engagement with each other to prevent further displacement movement of the legs from the respective adjusted position thereof and positively maintain the predetermined trip points of switches 13, 13*a* (FIGS. 1 and 4).

Figure 2:
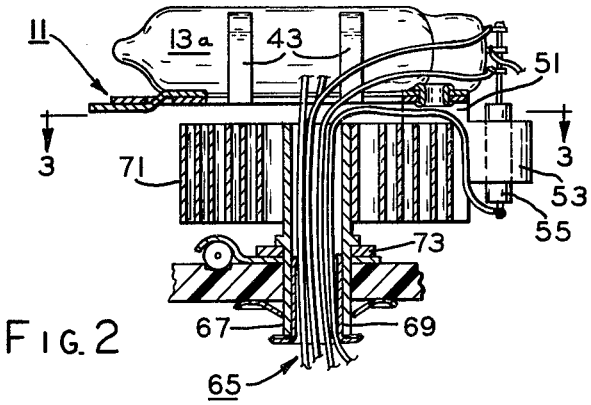
FIG. 2 is a partial sectional view taken along line 2—2 of FIG. 1.
Figure 3:
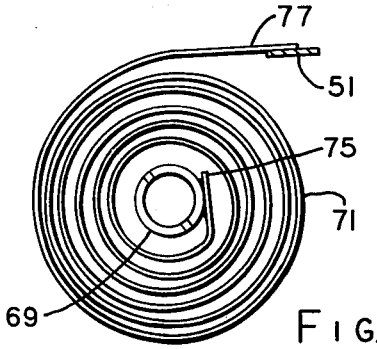
FIG. 3 is a partial sectional view taken along line 3—3 of FIG. 2.

More particularly and with specific reference to FIGS. 1, 2 and 4, legs 17, 19 of cradle 11 are generally planar being formed from a generally thin sheet or strip of metallic material, and a pair of generally opposite ends or end portions 29, 31 and 33, 35 are respectively provided on the legs with adjacent ones of the end portions disposed, at least in part, in overlaying relation with respect to each other. Intermediate portions 37, 39 of legs 17, 19 are respectively integrally formed between opposite end portions 29, 31 and 33, 35, and the intermediate portions are disposed generally in laterally spaced relation with respect to each other. Means, such as a pair of pluralities of gripping fingers 41, 43, are integrally formed or associated with intermediate portions 37, 39 for supporting or mounting switches 13, 13*a* thereon, and means, such as a rivet 45 or the like for instance, is engaged between adjacent opposite end portions 29, 33 of legs 17, 19, respectively, for pivotally interconnecting or associating them so that the legs may be adjustably moved or pivoted with respect to each other toward their respective adjusted positions thereby to define or establish the predetermined trip points of switches 13, 13*a*, as discussed hereinafter, when the switch means are disposed in gripping or mounting engagement with gripping fingers 41, 43.

Figure 5:
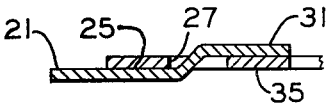
FIG. 5 is a sectional view taken along line 5—5 of FIG. 4.
Figure 6:
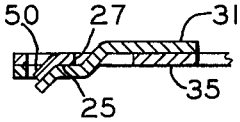
FIG. 6 is a sectional view corresponding to FIG. 5 and illustrating an alternative connection between the cradle legs in one form of the invention.

Opening 27 comprises a generally elongate slot and is provided through opposite end portion 35 of leg 19, and integral extension or extension means 21 comprises a tab or finger integral with opposite end portion 31 of leg 17; however, it is contemplated that opening 27 and extension means 21 may be of various shapes or configurations other than as shown for purposes of disclosure within the scope of the invention so as to meet the objects thereof. As also shown in FIG. 5, extension means 21 is offset, at least in part, from the plane of leg 17 and extends through opening 27 so as to be at least closely adjacent the portion 25 of leg 17 disposed or extending generally about the opening. Extension means 21 is movable within opening 27 upon the adjustable pivoting of legs 17, 19 about rivet or pivotally interconnecting means 45, and a pair of end walls or abutments 47, 49 are provided on opposite end portion 35 of leg 19 for engagement with the extension means so as to predeterminately limit the adjusting pivotal movement of the legs. Extension means 21 is adapted for fixed interconnection with the part or portion 25 of leg 19 disposed generally about opening 27 by suitable means, such as for instance soldering or the like (not shown), so as to maintain the legs against further pivotal displacement movement from the respective adjusted position thereof once the trip points of switches 13, 13*a* have been established or set. However, in an alternative construction, as shown in FIG. 6, extension means 21 is shown as extending through opening 27, and both the extension and portion 25 of leg 19 are deformed, such as by lancing, staking or punching or the like for instance, so as to provide a displaced tab 50 depending generally from the planes of the extension means and portion 25 of leg 19. In this manner, it is believed that the interference fitting engagement between deformed tab 50 and both extension means 21 and portion 25 of leg 19 may be great enough to prevent further pivotal displacement movement of legs 17, 19 from their respective adjusted positions. A mounting or weld tab 51 is integrally formed on leg 19 adjacent intermediate portion 39 so as to depend therefrom, and the tab includes a section of portion 53 bent generally back upon itself for releasably or resiliently retaining a heat anticipator, such as a resistor 55 or the like for instance, as shown in FIG. 2.

Thermostat 11 is intended to be operative in a heating mode and a cooling mode and, of course, includes an electrical circuit (not shown) for controlling a system for conditioning the temperature of a given space in which the thermostat may be located, and if greater detail of the construction of the thermostat and the connections of electrical circuit are desired, reference may be had to the aforementioned application Ser. No. 750,280 filed Dec. 13, 1976 (now U.S. Pat. No. 4,114,681 issued Sept. 19, 1978).

Switches 13, 13*a* form a part of the electrical circuit for thermostat 11 and are of the mercury type well known to the art, as previously mentioned, and while the switches are illustrated generally as single pole, double throw switches, at least one of the switches may be of the single pole, single throw type also well known in the art. Since switches 13, 13*a* are disclosed herein as identical, only switch 13 will be described hereinafter, and any subsequent reference to corresponding parts of switch 13*a* will be designated by the letter "a". Switches 13, 13*a* are mounted or supported on intermediate portions 37, 39 of cradle legs 17, 19 being respectively received by gripping fingers 41, 43 thereof. Switch 13 includes a sealed glass tube 57 having a globule of mercury 59 movable therein for electrical circuit making and breaking engagements between a plurality of contacts or a pair of sets of contacts 60, 61 and 61, 63, respectively embedded or otherwise disposed in the glass tube depending of course upon the degree of inclination of the switch from the horizontal, as discussed hereinafter. As shown in FIG. 1, a plurality of electrical circuit leads 65 are connected with contacts 60, 61, 63, and the leads are passed through a bore 67 of a post 69 of thermostat for connection with other components of the electrical circuit (not shown).

Post 69 is rotatably retained and mounted by suitable means in thermostat 15, as shown in FIG. 2, for mounting both a bimetal element 71 and a temperature selector arm 73 which is manually movable within a preselected temperature range to set a preselected temperature for the given space in which the thermostat may be located. Bimetal element or temperature sensing means 71 is mounted in thermostat 15 so as to be conjointly movable with indicating arm 73 and post 69 and is operable to sense the temperature of the given space in which the thermostat may be located. Bimetal element 69 comprises a strip of bimetal material of any suitable type wound into a permanent generally spiral shape or configuration having radially inner and outer ends 75, 77. Inner end 75 is attached by suitable means, such as a spot weld for instance (not shown), to post 69, and outer end 77 is attached by suitable means, such as a spot weld for instance (not shown), with mounting tab 51 of cradle 11 so that the cradle is conjointly movable with bimetal element 71 in response to the temperature of the given space sensed by the bimetal element.

With reference again in general to the drawings and recapitulating at least in part with respect to the foregoing, a method is illustrated for making or manufacturing cradle 11 for use in thermostat 15 to support switches 13, 13*a* respectively adapted for operation at predetermined switch points. This method includes the steps of: fabricating from generally planar thin material the legs 17, 19 respectively having opposite end portions 29, 31 and 33, 35 with opening 27 in opposite end portion 35 and integral extension means on opposite end portion 31; and pivotally interconnecting opposite end portions 29, 33 so that the legs are disposed at least in part in overlaying and laterally spaced relation with respect to each other and inserting the integral extension means through the opening (FIG. 4).

More particularly and with specific reference to FIG. 4, legs 17, 19 are blanked, stamped or otherwise formed from a generally thin and planar sheet or strip of metallic material so as to provide the shapes or configurations of the legs discussed hereinbefore, and opposite end portions 29, 33 are then associated with each other in the pivotal interconnection and overlaying relation so that rivet 45 may be applied thereto to form the pivotal interconnection. With opposite end portions 29, 33 so associated with each other, at least intermediate portions 37, 39 of legs 17, 19 are generally laterally spaced from each other, and as opposite end portions are so associated with each other, integral extension 21 may be inserted or extended through opening 27.

Switches 13, 13*a* are mounted to intermediate portions 37, 39 of legs 17, 19, and cradle 11 is placed in a fixture of a calibration apparatus (not shown) so as to be disposed in a generally vertical plane with respect to a reference or horizontal plane which may be thought of as being generally perpendicular to the plane of the drawing sheet FIG. 4; however, for the sake of brevity, a description of the aforementioned fixture and calibration apparatus is omitted. With cradle 11 so positioned in its vertical plane, an operator applies a force onto weld tab 51 so as to pivot leg 19 about rivet 45, i.e. the pivot point of the cradle, and in response to such pivoting or tilting of leg 19 with respect to the horizontal plane, mercury globule 59*a* of switch 13*a* moves within glass tube 57*a* thereof toward making engagement between the interior ends of contacts 60*a*, 63*a*. The applied force is removed from weld tab 51 of leg 19 so as to eliminate further pivotal movement of the leg upon the engagement of mercury globule 59*a* with contacts 60*a*, 63*a* of switch 13*a*, and of course, this inclination of leg 19 with respect to the horizontal plane when the mercury globule is disposed in making engagement between the contacts predetermines the trip point of switch 13*a*.

Assuming that switch 13 is adapted to make after switch 13*a*, the fixture (not shown) with cradle 11 mounted therein is rotated in the vertical plane a preselected number of degrees, for instance through an arc of approximately one degree, and an operator applied force is exerted on extension means 21 leg 17 so as to pivot it about rivet 45 with respect to leg 19 and the horizontal reference plane. In response to such pivoting or tilting of leg 17 respect to the horizontal plane, mercury globule 59 of switch 13 moves within glass tube 57 thereof toward making engagement between the interior ends of contacts 60, 63. The applied force is removed from leg 17 so as to eliminate further pivotal movement thereof when mercury globule 59 moves into making engagement between contacts 60, 63 of switch 13, and this inclination of leg 17 with respect to the horizontal plane when the mercury globule is disposed in making engagement between the contacts predetermines the trip point of switch 13. In this manner, cradle legs 17, 19 are adjustably positioned with respect to each other, and the trip points of switches 13, 13*a* are predetermined so that switch 13*a* makes a preselected number of arcuate degrees before switch 13 in response to the rotation of cradle 11 in the vertical plane.

With switches 13, 13*a* so calibrated in the adjusted positions of cradle legs 17, 19, extension means 21 is now attached by suitable means, such as soldering or the like for instance (not shown), to the part 25 of leg opposite end portion 35 extending generally about opening 27 therein. This attachment of extension means 21 to opposite end portion 35 not only maintains legs 17, 19 against pivotal displacement movement from their respective adjusted positions but also fixes or maintains the predetermined trip points of switches 13, 13*a* with respect to each other. While leg 19 is described hereinabove as being moved prior to leg 17 in order to set the predetermined trip point of switches 13, 13*a* for purposes of disclosure, it is contemplated that leg 17 could be moved prior to leg 19 in order to set the predetermined trip points of the switches within the scope of the invention so as to meet the objects thereof. Furthermore, instead of attaching legs 17, 19 by soldering or the like, it is believed that tab 50 may be lanced, punched or otherwise deformed from extension means 21 and portion 25 of leg 19, as shown in FIG. 6, so that the interference engagement between tab 50 and both extension means 21 and portion 25 of leg 19 will be effective to prevent pivotal displacement movement of legs 17, 19 from their adjusted positions so as to maintain the predetermined trip points of switches 13, 13*a*.

In the operation of thermostat 15, an operator applied force is exerted on indicator arm 73 to move it to a temperature setting indicating the preselected temperature desired for the given space in which theremostat 15 may be located. This movement of indicator arm 73 in response to the operator applied force thereon conjointly drives or rotates post 69 in thermostat 15, and bimetal element 71 mounted to the post is conjointly rotatable therewith to an adjusted or temperature sensing position in the thermostat correlative or indicative of the chosen temperature setting of the preselected temperature. In this adjusted position, bimetal element 69 contracts and expands in response to variances of the temperature of the given space from the preselected temperature chosen therefor. Since cradle 11 is mounted to outer end 77 of bimetal element 69, the cradle is conjointly movable with the bimetal element in response to the temperature sensing or expansion and contraction movement thereof so as to control the circuit making and breaking actuation of switches 13, 13*a* mounted to the cradle.

Assuming thermostat 15 to be enabled for heating mode operation and that the temperature of the given space acting on bimetal element 69 falls below the preselected temperature, the bimetal element contracts in response thereto so as to tilt or effect the rotation of cradle 11 in a clockwise direction (as best seen in FIG. 1). The clockwise rotation of cradle 11 also tilts or rotates switch 13*a* to its predetermined trip position causing its mercury globule 59*a* to move into circuit making engagement between contacts 60*a*, 63*a* of the switch thereby to complete a thermostat heating electrical circuit (not shown) associated with the given space in order to supply heat thereto. So long as thermostat 15 is "calling", as described above, heat will be supplied to the given space until the temperature thereof is raised to approximate the preselected temperature for the given space. Of course, bimetal element 69 is subjected to the heat supplied to the given space and expands in response thereto so as to tilt or effect the rotation of cradle 11 in a counterclockwise direction (as best seen in FIG. 1). This counterclockwise rotation of cradle 11 also tilts or returns switch 13*a* toward its original position causing the mercury globule 59*a* thereof to move to its circuit breaking position disengaged from contacts 60*a*, 63*a* of the switch thereby to interrupt the thermostat heating electrical circuit so as to deenergize the heating system associated with the space. Of course, while mercury globule 59*a* may make with contacts 60*a*, 61*a*, these contacts are not now in the circuit since thermostat 15 is operating in its heating mode, as previously mentioned. Thermostat 15 will continue to cycle in its heating mode operation, as discussed above, in response to any further variances in the temperature of the given space from the preselected temperature thereof.

Assuming now that thermostat 15 is enabled for its cooling mode operation and that the temperature of the given space acting on bimetal element 69 rises above the preselected temperature, the bimetal element expands in response thereto so as to again tilt or effect the rotation of cradle 11 in the counterclockwise direction. This counterclockwise rotation of cradle 11 also tilts or rotates switch 13*a* to its predetermined trip position causing its mercury globule 59*a* to move into circuit making engagement between contacts 60*a*, 61*a* of the switch to complete a thermostat cooling electrical circuit (not shown) for energizing a cooling system (not shown) associated with the given space in order to supply cooling air thereto. So long as thermostat 15 is "calling", as described above, cooling air will be supplied to the given space until the temperature thereof is lowered to approximate the preselected temperature. Of course, bimetal element 69 is subjected to the cooling air supplied to the given space and contracts in response thereto so as to tilt or effect the rotation of cradle 11 in the clockwise direction. This clockwise movement of cradle 11 also tilts or returns switch 13*a* toward its original position causing mercury globule 59*a* thereof to move to its circuit breaking position disengaged from contacts 60*a*, 61*a* of the switch thereby to interrupt the thermostat cooling electrical circuit so as to deenergize the cooling system associated with the given space. Of course, thermostat 15 will continue to cycle in its cooling mode operation, in response to any further variances in the temperature of the given space from the preselected temperature thereof.

For the sake of brevity, the foregoing discussion of the operation of thermostat 15 in its cooling mode and its heating mode omits the affect of heat anticipators which may be associated with bimetal element 69, omits the cooperative operation of switch 13, and also omits a switching arrangement for enabling the cooling mode operation and the heating mode operation of the thermostat; however, if greater details of the construction and operation of thermostat 15 is desired, reference may be made to Ser. No. 750,280 filed Dec. 13, 1976 (now U.S. Pat. No. 4,114,681 issued Sept. 19, 1978), as previously mentioned.

Figure 7:
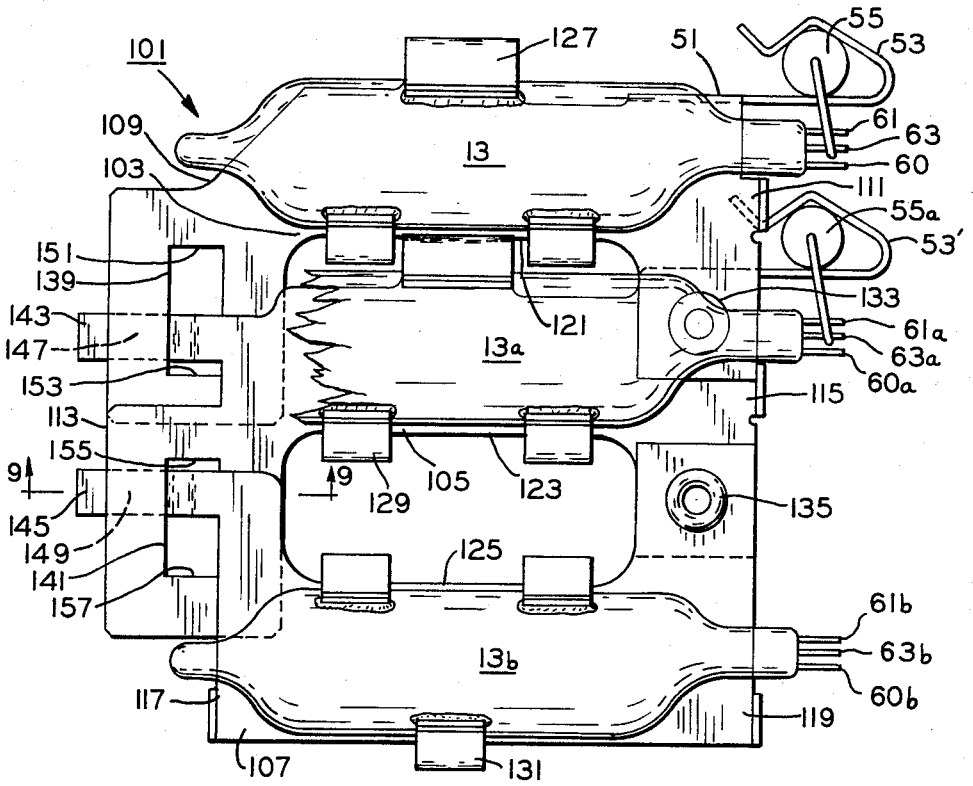
FIG. 7 is a plan view of another cradle assembly in one form of the invention and adapted for use in the thermostat of FIG. 1.

Referring now to FIG. 7 another or alternative cradle or cradle assembly 101 in one form of the invention is shown having generally the same component parts and functioning in thermostat 15 generally in the same manner as the previously described cradle 11 with the exceptions discussed hereinafter. While cradle 101 meets at least some of the objects and advantageous features set out hereinbefore, it is believed that the cradle may have additional indigenous objects and advantageous features which will be in part apparent and in part pointed out hereinafter.

Figure 8:
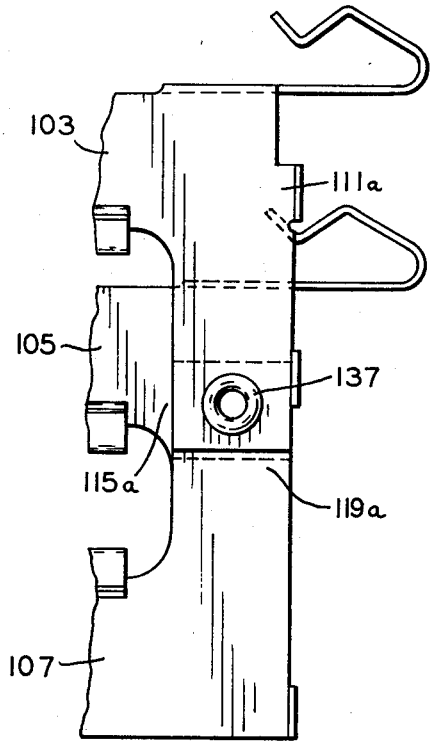
FIG. 8 is a fragmentary view taken from FIG. 7 illustrating an alternative pivotal connection for a leg plurality of the another cradle assembly in one form of the invention.

Cradle 101 supports or mounts a plurality of means, such as mercury switches 13, 13*a*, 13*b*, adapted for switching or being operable at predetermined trip or switch points in thermostat 15 of FIG. 1. Cradle 101 has a plurality of means, such as legs or leg means 103, 105, 107, for mounting or supporting switches 13, 13*a*, 13*b*, and such mounting means or legs may be blanked or otherwise formed from a generally thin sheet or strip of metallic material. A pair of generally opposite ends or end portions 109, 111; 113, 115; 117, 119 are respectively provided on legs 103, 105, 107 with each of adjacent ones of such opposite end portions being disposed, at least in part, in overlaying relation with another one of such adjacent opposite end portions. Intermediate portions 121, 123, 125 of legs 103, 105, 107 are respectively intergrally formed with opposite end portions 109, 111; 113, 115; 117, 119, and the intermediate portions are disposed generally in laterally spaced relation with respect to each other. Means, such as pluralities of gripping fingers 127, 129, 131, are integrally formed or associated with intermediate portions 121, 123, 125 of legs 103, 105, 107 for gripping or positioning engagement with switches 13, 13*a*, 13*b* so as to support or otherwise mount them on legs 103, 105, 107, respectively. Means, such as a pair of rivets 133, 135 or the like for instance, is engaged between opposite end portions 113, 115 and 115, 119 of legs 103, 105, 107 for associating or pivotally interconnecting them so that the legs may be adjustably moved or pivoted with respect to each other toward respective adjusted positions in order to define or establish the predetermined trip points of switches 13, 13*a*, 13*b* when the switches are disposed on the legs in gripping or mounting engagement with gripping fingers 127, 129, 131 thereof, respectively. Of course, as shown in the alternative construction of FIG. 8, legs 103, 105, 107 may, if desired, be provided with extended opposite end portions 111*a*, 115*a*, 119*a* which may be disposed in overlaying relation with each other so that only one rivet or pivotally interconnecting means 137 connects or associates opposite end portions 111*a*, 115*a*, 117*a* of legs 103, 105, 107, respectively.

Figure 9:
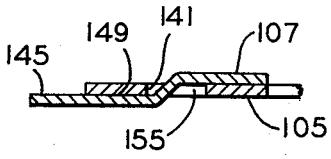
FIG. 9 is a sectional view taken along line 9—9 of FIG. 7.
Figure 10:
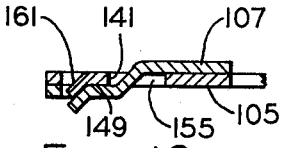
FIG. 10 is a sectional view corresponding to FIG. 9 and illustrating an alternative connection between the cradle legs in one form of the invention.

A pair of openings or generally elongate slots 139, 141 are provided or formed through opposite end portions 109, 113 of legs 103, 105, and a pair of integral extensions or extension means, such as tabs or fingers 143, 145 for instance, are integrally provided or formed on opposite end portions 113, 117 of legs 105, 107, respectively. As also shown in FIG. 9, extension means 143, 145 are offset, at least in part, from the plane of legs 105, 107 and extend through openings 139, 141 so as to be disposed at least closely adjacent or in abutment with respective parts or portions 147, 149 of legs 103, 105 disposed generally adjacent or extending generally about openings 139, 141 therein, respectively. Extension means 143, 145 are movable within openings 139, 141 upon the adjustable movement of legs 103, 105, 107 about rivets 133, 135, and pair of end walls or abutments 151, 153 and 155, 157 are provided on opposite end portions 109, 113 of legs 103, 105 for engagement with the extension means so as to predeterminately limit the adjustable movement of legs 103, 105, 107, respectively. Extension means 143, 145 are adapted for fixed interconnection in displacement preventing engagement directly with parts 147, 149 of legs 103, 105 by suitable means, such as soldering or the like for instance (not shown), so as to maintain legs 103, 105, 107 against further adjustable or pivotal movement from the respective adjusted positions thereof once the trip points of switches 13, 13*a*, 13*b* have been established, as discussed hereinafter in greater detail. In an alternative construction in one form of the invention, as shown in FIG. 10, extension means 145 is shown extending through opening 141, and both the extension means and part 149 of leg 107 are deformed, such as by lancing, staking or punching or the like for instance, so as to provide a displaced tab 161 depending from the planes of the extension means and part 149 of leg 107. Thus, the interference between displaced tab 161 and both extension means 145 and part 149 of leg 107 may be great enough to prevent the further adjustable movement of legs 105, 107 from their respective adjusted positions. Of course, extension means 143 and part 147 of leg 103 may be deformed generally in the same manner as discussed above with respect to extension means 145.

Figure 11:
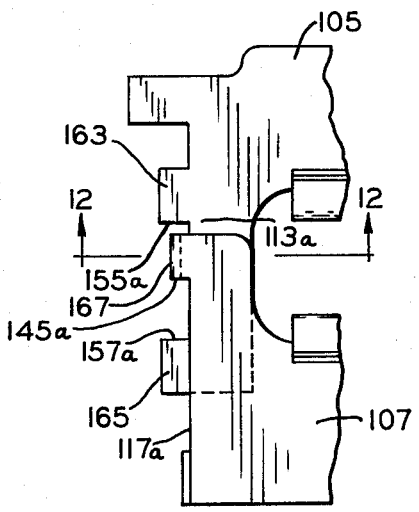
FIG. 11 is a fragmentary view of the cradle assembly of FIG. 7 showing an alternative form of the cradle legs in one form of the invention.
Figure 12:
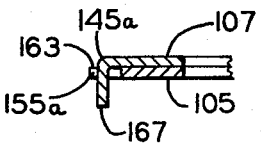
FIG. 12 is a partial sectional view taken along line 10—10 of FIG. 9.
Figure 13:
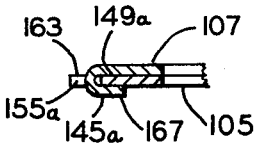
FIG. 13 is a sectional view corresponding to FIG. 12 and illustrating an alternative connection between the cradle legs in one form of the invention.

While extension means 145, 147 and openings 139, 141 are provided with the configurations disclosed herein, it is contemplated that opposite end portions 109, 113, 117 of legs 103, 105, 107 may be provided with various other shapes or configurations each adapted for displacement preventing engagement with another thereof so as to meet the objects of the invention. For instance, in an alternative construction shown in FIG. 11 in one form of the invention, an opposite end portion 113*a* of leg 105 is provided with a pair of predeterminately spaced apart tabs or extensions 163, 165 which define a pair of opposed spaced abutments 155*a*, 157*a*. An extension means 145*a* is integrally formed opposite end portion 117 of leg 107 so as to be movable between tabs 163, 165, and the extension means includes a depending lip or the like 167 on the distal or free end thereof. Of course, lip 167 on extension means 145*a* is adapted for abutment or engagement with tab abutments 155*a*, 157*a* so as to predeterminately limit the adjustable movements of legs 105, 107 to the respective adjusted positions thereof. When legs 105, 107 are disposed in their respective adjusted positions, extension means 145*a* may be fixedly interconnected in displacement preventing engagement with a part 149*a* of leg 105 between tabs 163, 165 by suitable means, such as soldering for instance (not shown). In the alternative construction shown in FIG. 13 in one form of the invention, lip 167 of extension means 145*a* may be bent or otherwise deformed into engagement with the underneath side of leg 105 so that extension means 145*a* has a generally U-shaped configuration. In this configuration, extension means 145*a* may be soldered to part 149*a* of leg 105 or may be staked thereto, as previously discussed hereinabove.

Figure 14:
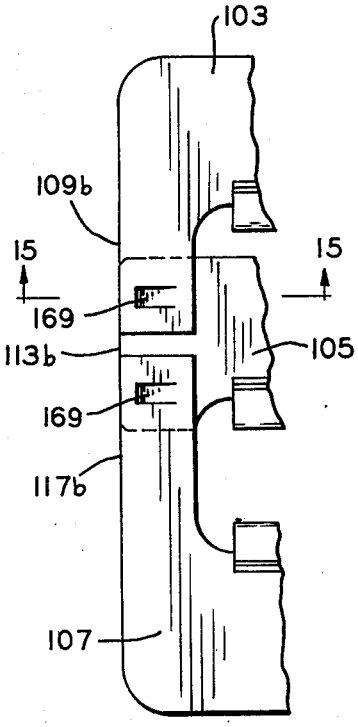
FIG. 14 is a fragmentary view of the cradle assembly of FIG. 7 showing an alternative form of the cradle legs in one form of the invention.
Figure 15:
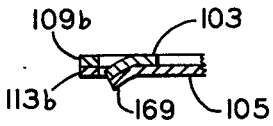
FIG. 15 is a partial sectional view taken along line 13—13 of FIG. 12.

In the alternative construction shown in FIG. 14 in one form of the invention, a pair of opposite end portions 109*b*, 117*b* on legs 103, 107 are disposed in overlaying relation with an opposite end portion 113*b* on leg 105, and upon movement of legs 103, 105, 107 to their respective adjusted positions, opposite end portions 109*b*, 117*b* may be connected in displacement preventing engagement directly to opposite end portion 113*b* by suitable means, such as soldering (not shown) for instance, thereby to prevent further adjusting movement of the legs from their respective adjusted positions once the predetermined trip points of switches 13, 13*a*, 13*b*, have been established. Instead of interconnecting opposite ends 109*b*, 113*b*, 117*b* by soldering, the opposite end portions may also be alternatively interconnected in one form of the invention as shown in FIG. 15 wherein a tab 169 is deformed, such as by lancing, staking, punching or the like for instance, from opposite end portions 113*b*, 117*b*. Thus, it is believed that tabs 169 as displaced from the general plane of legs 105, 107 will effect enough interfering engagement or interlocking between opposite end portions 113*b*, 117*b* thereof so as to prevent further movement of the legs from their respective adjusted positions. Of course, another tab (not shown) similar to tab 169 may be deformed from opposite end portions 109*b*, 113*b* so as to interlock legs 103, 105 against further movement from their respective adjusted positions.

With further reference to FIG. 7, cradle 101 is provided with weld tab 51 which is integrally formed on leg 103 so as to depend therefrom, and tab section 53 releasably retains resistor 55, as previously discussed. Cradle 101 may be mounted in thermostat 15 of FIG. 1 by attaching weld tab 51 of leg 103 to outer end 77 of bimetal element 71 by suitable means, such as welding or the like for instance, so that the cradle is conjointly movable with the bimetal element in response to temperature changes in the given space in which the thermostat may be mounted. Switch 13*b* may be of the same construction as the previously described switches 13, 13*a*, i.e. either a single pole single throw mercury switch or a single pole, double throw mercury switch; therefor, and reference to corresponding component parts of switch 13*b* will be designated by the letter "b". Further, the lead plurality 65, as discussed hereinabove, includes the leads connected with contacts 60*b*, 61*b*, 63*b* of switch 13*b*.

When switches 13, 13*a*, 13*b* are mounted to intermediate portions 121, 123, 125 of legs 103, 105, 107 and cradle 101 is placed in a fixture of the aforementioned calibration apparatus (not shown) so as to be disposed in a generally vertical plane with respect to a reference or horizontal plane which may be thought of as being generally perpendicular to the plane of the drawing sheet FIG. 7; however, for the sake of brevity, a description of the aforementioned fixture and calibration apparatus is omitted. With cradle 101 so positioned in its vertical plane, an operator applies a force onto opposite end portion 109 of leg 103 so as to pivot or adjustably move it about rivet 133, and in response to such adjusting movement of leg 103 with respect to the horizontal plane, mercury globule 59*a* of switch 13*a* moves within glass tube 57*a* thereof toward engagement between the interior ends of contacts 60*a*, 63*a*. The applied force is removed from leg 103 so as to eliminate further pivotal movement of the leg upon the engagement of mercury globule 59*a* with contacts 60*a*, 63*a* of switch 13*a*, and of course, this inclination of leg 19 with respect to the horizontal plane when the mercury globule is disposed in making engagement between the contacts predetermines the trip point of switch 13*a* and defines the adjusted position of leg 103.

Assuming that switch 13 is adapted to make after switch 13*a*, the fixture (not shown) with cradle 101 mounted therein is rotated in the vertical plane a preselected number of degrees, for instance through an arc of approximately one degree, and an operator applied force is exerted on opposite end portion 113 of leg 105 so as to pivot it about rivet 133 with respect to leg 103 in its respective adjusted position and the horizontal reference plane. In response to such adjusting movement of leg 105, mercury globule 59 of switch 13 moves within glass tube 57 thereof toward making engagement between the interior ends of contacts 60, 63. The applied force is removed from leg 105 so as to eliminate further pivotal or adjusting movement thereof when mercury globule 59 moves into making engagement between contacts 60, 63 of switch 13, and this inclination of leg 105 with respect to the horizontal plane when the mercury globule is disposed in making engagement between the contacts predetermines the trip point of switch 13 and defines the respective adjusted position of leg 105.

If it is desired that switch 13*b* make after switch 13, the fixture (not shown) with cradle 101 mounted therein is rotated in the vertical plane another preselected number of degrees, and another operator applied or adjusting force is exerted on opposite portion 117 of leg 107 so as to pivot it about rivet 135 with respect to leg 105 in its respective adjusted position and the horizontal reference plane. In response to such adjusting movement of leg 107, mercury globule 59*b* of switch 13*b* moves within glass tube 57*b* thereof toward making engagement between interior ends of contacts 60*b*, 63*b*. The applied or adjusting force is then removed from leg 107 so as to eliminate further pivotal or adjusting movement thereof when mercury globule 59*b* is made between contacts 60*b*, 63*b* of switch 13*b*, and this inclination of leg 107 with respect to the horizontal plane when the mercury globule is disposed in making engagement between the contact predetermines the trip point of switch 13*b* and defines the respective adjusted position of leg 107.

With switches 13, 13*a*, 13*b* so calibrated in the adjusted positions of cradle legs 103, 105, 107, extension means 143, 145 are attached by suitable means, such as soldering or the like for instance (not shown), to parts 147, 149 of leg opposite end portions 109, 113 extending generally about openings 139, 141 therein. This attachment of extension means 143, 145 to opposite end portions 109, 113 not only maintains legs 103, 105, 107 against further pivotal displacement movement from their adjusted positions but also fixes or maintains the predetermined trip points of switches 13, 13*a*, 13*b* with respect to each other. While the movement of legs 103, 105, 107 so as to set the trip points of switches 13, 13*a*, 13*b* have been described above for purposes of disclosure, it is contemplated that such legs could be moved in any desired order to their respective adjusted positions within the scope of the invention so as to meet the objects thereof. Further, it is also contemplated that legs 103, 105, 107 may be soldered, as described above, as they are moved into their respective adjusted positions or after all such legs are disposed in their respective adjusted positions. Instead of attaching legs 103, 105, 107 in their respective adjusted positions by soldering or the like, it is believed that tabs 161 may be lanced, punched or otherwise deformed from extension means 143, 145 and portions 147, 149 of legs 109, 113, as shown in FIG. 10, so that the interference engagement therebetween will be effective to prevent pivotal displacement movement of legs 103, 105, 107 from their adjusted positions so as to maintain the predetermined trip points of switches 13, 13*a*, 13*b*, as previously discussed. Of course, it is contemplated that either of extension means 143, 145 may be suitably attached to its cooperating part 147, 149 of legs 103, 105 prior to the other of the extension means whenever two of the legs 103, 105, 107 are disposed in their respective adjusted positions. Further and with respect to the alternative embodiments of the invention shown in FIGS. 11–15, legs 103, 105, 107 may be fixedly interconnected when adjustably moved to their respective adjusted positions in the manner disclosed and previously discussed hereinabove.

When cradle 101 is mounted to outer end 77 of bimetal element 69 of thermostat 15, the thermostat operates generally in the same manner as described hereinbefore except that switch **13*b*** may be connected in the thermostat heating electrical circuit for controlling another heating stage in the heating system, as is well known to the art.

With reference in general to FIGS. 7–15 and recapitulating at least in part with respect to the foregoing; a method is illustrated for making or manufacturing cradle 101 for use in thermostat 15 to support switches **13, 13*a*, 13*b* respectively adapted for switching operation at predetermined switch points. In this method, leg plurality 103, 105, 107 are fabricated by stamping, blanking or other suitable means from generally planar and thin metallic material with each of the legs having a pair of opposite end portions 109, 111; 113, 115; 117, 119. Opposite end portions 111, 115, 119 are pivotally arranged as associated with respect to each other. Each of opposite end portions 109, 113, 117 includes at least one integrally formed means, such as extension means 143, 145 and parts 147, 149 for instance, adapted for fixed connection in displacement preventing engagement directly with another one of such integrally formed means on another one of the opposite end portions so as to positively attach or secure legs 103, 105, 107 in respective adjusted positions with respect to each other thereby to positively establish the predetermined switch points of switches 13, 13*a*, 13*b*** respectively on the legs.

While cradles 11, 101 are respectively provided with two and three switch carrying legs, as discussed above, it is contemplated that other cradles having more than three switch carrying legs may be utilized within the scope of the invention so as to meet the objects thereof.

From the foregoing, it is now apparent that novel cradles 11, 101 are presented meeting the objects and advantages therefor set out hereinbefore and that changes as to the precise arrangements, shapes, details and connections of the constructions illustrated herein by way of example may be made by those having ordinary skill in the art without departing from the spirit of the invention or the scope thereof as defined by the claims which follow.

What I claim as new and desire to secure by Letters Patent of the United States is:

1. A cradle assembly for use in a thermostat comprising a plurality of switch means respectively adapted for switching operation at predetermined switch points, a plurality of leg means for supporting said switch means and including a pair of generally opposite end portions with an adjacent one of said opposite end portions of each of said leg means being pivotally arranged with respect to each other so that said leg means are pivotally movable toward adjusted positions to establish the predetermined switch points of said switch means, respectively, the adjacent other of said opposite end portions of said each leg means including at least one integral part conjointly pivotally movable with a respective one of said leg means into abutting engagement with another of said at least one integral part on another of said other opposite end portions so as to positively limit the pivotal movement of said leg means toward their respective adjusted positions, and said another of said at least one integral part including an opening therein defining a pair of spaced apart abutment means for the abutting engagement with said at least one integral part.

2. A cradle assembly as set forth in claim 1 wherein said at least one integral part extends through said opening.

3. A cradle assembly as set forth in claim 1 wherein said at least one integral part comprises extension means adapted for deformation into displacement preventing engagement with said another of said at least one integral part at least generally adjacent said opening therein to maintain said legs against displacement movement from the adjusted positions thereof.

4. A cradle assembly as set forth in claim 1 further comprising means associated with said at least one integral part and said another of said at least one integral part for maintaining said leg means in their respective adjusted positions.

5. A cradle adapted for mounting engagement with a bimetal element of a thermostat, the cradle comprising a plurality of legs, a pair of opposite end portions respectively on said legs of said plurality thereof, an intermediate portion on said legs between the opposite end portions thereof, respectively, a plurality of switch means adapted for switching operation at a predetermined trip point, respectively, means associated with said intermediate portions for supporting said switch means of said plurality thereof on said legs, respectively, means for pivotally associating one of the opposite end portions of said legs so that said legs may be adjustably pivotally movable with respect to each other toward respective adjusted positions defining the respective predetermined switch points of said switch means supported on said legs, an opening in the other of said opposite end portion of at least one of said legs of said plurality thereof, at least one extension on said other opposite end portion of at least another of said legs of said plurality thereof and extending through said opening, and at least one of said at least one extension means and said opening being movable with respect to the other thereof upon the adjustable pivoting movement of at least one of said at least one leg and said another leg to the respective adjusted position thereof and said at least one extension means being fixedly interconnected in displacement preventing engagement with a part of said at least one leg disposed generally adjacent said opening so as to prevent further adjustable pivoting movement of said at least one of said at least one leg and said another leg from the respective adjusted position thereof, and means on said cradle adapted for the mounting engagement with the bimetal element.

6. A cradle for use in a thermostat for supporting a pair of switch means comprising a pair of legs disposed at least in part in laterally spaced relation, a pair of opposite end portions on said legs, respectively, one of said opposite end portions of said legs being disposed at least in part in overlaying relation, means for pivotally interconnecting said one opposite end portions of said legs, an opening in the other of said opposite end portions of one of said legs, in integral extension on the other of said opposite end portions of the other of said legs and extending through said opening, said extension being movable within said opening in response to adjusting pivotal movement of said legs about said interconnecting means toward adjusted positions of said legs, and said extension means being adapted for fixed interconnection with a pair of said other opposite end portion of said leg disposed at least generally adjacent said opening so as to maintain said legs in their adjusted positions.

7. A cradle as set forth in claim 6 wherein said legs include a pair of intermediate portions between said opposite end portions thereof and disposed generally in the laterally spaced apart relation to support the switch means, respectively.

8. A cradle as set forth in claim 6 wherein said opening includes a pair of spaced apart side walls arranged to abut with said extension means so as to limit the adjusting pivotal movement of said legs about said interconnecting means.

9. A cradle as set forth in claim 6 wherein said extension means includes a folded over portion engaged with said part of said other opposite end portion of said other leg disposed at least generally adjacent said opening so as to maintain said legs in their adjusted positions at least generally.

10. A cradle as set forth in claim 6 further comprising means for attaching said extension means to said part of said other opposite end portion of said other leg disposed adjacent said opening so as to maintain said legs in their adjusted positions.

11. A cradle assembly for use in a thermostat comprising a plurality of switch means respectively adapted for switching operation at a predetermined trip point, a plurality of leg means for respectively supporting said switch means and pivotally arranged with respect to each other for adjustable movement toward adjusted positions establishing the predetermined trip point of said switch means, and each of said leg means including a deformed portion arranged in interfering fitting engagement with another deformed portion on another of said leg means so as to obviate displacement movement of said leg means from the adjusted positions thereof and maintain the predetermined trip points of said switch means.

12. A cradle assembly for use in a thermostat comprising a plurality of switch means respectively adapted for switching operation at predetermined switch points, a plurality of means for mounting said switch means and pivotally arranged with respect to each other so as to be adjustably movable into adjusted positions establishing the predetermined trip points of said switch means, respectively, a pair of sets of abutments predeterminately spaced apart on two of said mounting means, respectively, and a pair of means on a third one of said mounting means and one of said two mounting means for engagement with said abutment sets to limit the adjusting movement of said mounting means.

13. A cradle assembly as set forth in claim 12 wherein said two mounting means include a pair of openings therein defining said abutment sets, respectively.

14. A cradle assembly as set forth in claim 13 wherein said engagement means pair comprise a pair of integrally formed extensions on said third one of said mounting means and said one of said two mounting means and arranged to extend at least in part through said openings, respectively.

15. A cradle assembly as set forth in claim 14 further comprising means for securing said extensions to said two mounting means at least generally adjacent said openings therein to maintain said mounting means in the adjusted positions thereof, respectively.

16. A cradle assembly as set forth in claim 12 further comprising means for securing said engagement means to said two mounting means so as to maintain said mounting means against displacement movement from the adjusted positions thereof, respectively.

17. A cradle assembly as set forth in claim 12 wherein at least a portion of each of said engagement means is deformed into displacement preventing engagement with said two mounting means so as to maintain said mounting means against displacement movement from the adjusted positions thereof, respectively.

18. A cradle assembly for use in a thermostat comprising a plurality of switch means respectively adapted for switching operation at predetermined switch points, a plurality of leg means for supporting said switch means and including a pair of generally opposite end portions with an adjacent one of said opposite end portions of each of said leg means being pivotally arranged with respect to each other so that said leg means are pivotally movable toward adjusted positions to establish the predetermined switch points of said switch means, respectively, the adjacent other of said opposite end portions of said each leg means including at least one integral part conjointly pivotally movable with a respective one of said leg means into abutting engagement with another of said at least one integral part on another of said other opposite end portions so as to positively limit the pivotal movement of said leg means toward their respective adjusted positions, and said at least one integral part and said another of said at least one integral part respectively including deformed portions arranged in interferring fitting engagement so as to maintain said legs against displacement movement from the adjusted positions thereof.

19. A cradle assembly for use in a thermostat comprising a plurality of switch means respectively adapted for switching operation at predetermined switch points, a plurality of leg means for supporting said switch means and including a pair of generally opposite end portions with an adjacent one of said opposite end portions of each of said leg means being pivotally arranged with respect to each other so that said leg means are pivotally movable toward adjusted positions to establish the predetermined switch points of said switch means, respectively, the adjacent other of said opposite end portions of said each leg means including at least one integral part conjointly pivotally movable with a respective one of said leg means into abutting engagement with another of said at least one integral part on another of said other opposite end portions so as to positively limit the pivotal movement of said leg means toward their respective adjusted positions, and said another of said at least one integral part including a pair of means predeterminately spaced apart for the abutting engagement with said at least one integral part.

* * * * *

UNITED STATES PATENT AND TRADEMARK OFFICE

CERTIFICATE OF CORRECTION

PATENT NO. : 4,271,400

DATED : June 2, 1981

INVENTOR(S) : Dann W. Denny

It is certified that error appears in the above—identified patent and that said Letters Patent is hereby corrected as shown below:

Col. 1, line 38, delete "also".
Col. 6, line 59, after "17" insert --with--.
Col. 7, line 36, delete "theremostat" and insert --thermostat--.
Col. 11, line 8, delete "tabs" and insert --tab--;
line 32, delete "and" and insert --any--;
line 52, after "toward" insert --making--.
Col. 12, line 19, after "opposite" insert --end--.
Col. 15, line 19, delete "at";
line 20, delete "least generally";
line 24, after "posed" insert --at least generally--.

Signed and Sealed this

Seventh Day of December 1982

[SEAL]

Attest:

GERALD J. MOSSINGHOFF

Attesting Officer

Commissioner of Patents and Trademarks